US008794205B2

(12) United States Patent
Nitz et al.

(10) Patent No.: US 8,794,205 B2
(45) Date of Patent: Aug. 5, 2014

(54) SWITCHABLE LEVER FOR A VALVE DRIVE OF AN INTERNAL COMBUSTION ENGINE

(75) Inventors: Norbert Nitz, Erlangen (DE); Robert Heinemann, Furth (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 150 days.

(21) Appl. No.: 13/582,896

(22) PCT Filed: Mar. 3, 2011

(86) PCT No.: PCT/EP2011/053186

§ 371 (c)(1),
(2), (4) Date: Sep. 5, 2012

(87) PCT Pub. No.: WO2011/113702

PCT Pub. Date: Sep. 22, 2011

(65) Prior Publication Data

US 2012/0325168 A1 Dec. 27, 2012

(30) Foreign Application Priority Data

Mar. 18, 2010 (DE) ..... 10 2010 011 828

(51) Int. Cl.
*F01L 1/20* (2006.01)
*F01L 13/00* (2006.01)
*F01L 1/18* (2006.01)

(52) U.S. Cl.
CPC ..... *F01L 13/0042* (2013.01); *F01L 2105/02* (2013.01); *F01L 1/185* (2013.01)
USPC ..... 123/90.44; 123/90.16

(58) Field of Classification Search
CPC .... F01L 2105/02; F01L 13/0042; F01L 1/185
USPC ..... 123/90.15, 90.16, 90.2, 90.21, 123/90.39–90.47
See application file for complete search history.

(56) References Cited

U.S. PATENT DOCUMENTS

| | | | | |
|---|---|---|---|---|
| 6,425,359 | B2 * | 7/2002 | Fujii et al. | 123/90.18 |
| 6,532,920 | B1 | 3/2003 | Sweetnam et al. | |
| 7,063,057 | B1 * | 6/2006 | Waters et al. | 123/90.16 |

(Continued)

FOREIGN PATENT DOCUMENTS

| | | |
|---|---|---|
| DE | 3315396 | 10/1984 |
| DE | 102007031815 | 1/2009 |

(Continued)

*Primary Examiner* — Thomas Denion
*Assistant Examiner* — Jorge Leon, Jr.
(74) *Attorney, Agent, or Firm* — Volpe and Koenig, P.C.

(57) ABSTRACT

The invention concerns a switchable lever (1) for a valve train of an internal combustion engine, said lever (1) comprising on one end (5), a bearing (6) for enabling a pivotal support of said lever (1) and, on another end (7), a support (9) for a gas exchange valve, a crossbar (2) of the lever (1) comprising a recess (10) comprising two cam rollers (11, 12) which are seated on an axle (15) mounted in bores (13, 14) of side walls (3, 4) of the lever (1) and displaceable in axial direction, a hollow axle (16) arranged on said axle (15) extending inwards out of the bore (13) of the first side wall (3), a first one of the cam rollers (11) being guided, axially fixed on said hollow axle (16) in front of an inner side (17) of the first side wall (3), said first cam roller (11) serving for a permanent contact of a first low lift cam (18) of a cam assembly (19), a second one of the cam rollers (12) being axially fixed on said axle (15) and being displaceable by said axle (15) into two positions, a first one of said positions serving to switch to a high valve lift during which the second cam roller (12) can be displaced through said axle (15) into a central position in the recess (10), so that a contact of a high lift cam (20) of the cam assembly (19) is enabled, a second one of said positions serving to switch off the high valve lift during which the second cam roller (12) can be displaced through the axle (15) into a position in front of the second side wall (4), so that a contact of a further low lift cam (21) of the cam assembly (19) is enabled.

8 Claims, 3 Drawing Sheets

(56) References Cited

U.S. PATENT DOCUMENTS

| | | | | |
|---|---|---|---|---|
| 7,918,201 | B2 * | 4/2011 | Yoshihara et al. | 123/90.39 |
| 8,033,260 | B2 * | 10/2011 | Reinecke-Murmann et al. | 123/90.39 |
| 2005/0056244 | A1 * | 3/2005 | Sellnau | 123/90.16 |
| 2007/0039578 | A1 * | 2/2007 | Evans et al. | 123/90.16 |
| 2007/0074688 | A1 * | 4/2007 | Fernandez et al. | 123/90.16 |
| 2007/0113813 | A1 | 5/2007 | Lalone | |
| 2008/0127917 | A1 * | 6/2008 | Riley et al. | 123/90.11 |

FOREIGN PATENT DOCUMENTS

| | | |
|---|---|---|
| DE | 102007040021 | 2/2009 |
| EP | 1149988 | 10/2001 |
| FR | 2694786 | 2/1994 |

* cited by examiner

SWITCHABLE LEVER FOR A VALVE DRIVE OF AN INTERNAL COMBUSTION ENGINE

BACKGROUND

The invention concerns a switchable lever for a valve train of an internal combustion engine, said lever comprising side walls connected by a crossbar and further comprising on one end, a bearing for enabling a pivotal support of said lever and, on another end, on an underside of said crossbar, a support for at least one gas exchange valve, said crossbar comprising between said one end and said another end, a recess which is bridged by a cam roller axle mounted in bores of said side walls, which lever, for switching to a high valve lift, can be brought into contact with at least one high lift cam and, for switching to a low or a zero valve lift, can be brought into contact with at least one low lift cam or one zero lift cam.

Switchable levers of the aforesaid type are sufficiently well known in the technical field and must not be described in detail in the present context. In the final analysis, such levers possess two arms, of which, a first arm serves for a contact with a high lift cam and a second arm seated in a recess of the first arm or laterally to this, serves for a contact, for example, with a low lift cam. Switching to the high lift cam is effected through coupling pistons which extend in one of the levers and, for achieving coupling, are displaced partially into the other lever. The arm destined for contact with the high lift cam usually comprises sliding surfaces for contact with this cam, whereas the arm for contact with the low lift cam possesses either a cam roller or likewise a sliding surface.

It is noted that the prior art levers have a structure that is too complex, are made up of too many separate parts and have an excessive design space requirement. Due to their relatively large mass, an undesired large amount of friction work is performed during operation. Due to the asymmetrical loading, depending on the structure in each case, the lever also develops an undesired tendency to tilt. A coupling lash in the coupling region has to be maintained, i.e. a minimum idle travel of the coupling element until it reaches its entraining surface on the other arm for achieving coupling. The adjustment of this coupling lash, which can even increase during operation, as also the guaranteeing of a reliable displacement of the coupling element, once the coupling command has been initiated, prove to be excessively complex.

SUMMARY

It is therefore an object of the invention to provide a switchable lever of the pre-cited type which is free of the aforesaid drawbacks. The lever intended to be made in mass production must have a simple structure, should have a light weight while being made up of a relatively small number of separate parts which can be assembled in a simple manner and easily and reliably switched.

The invention achieves the above objects by the fact that two cam rollers are seated on the axle in the recess, said axle being axially displaceable, a hollow axle arranged on said axle extends out of the bore of the first side wall axially inwards, a first one of the cam rollers being guided, axially fixed in front of an inner side of the first side wall, said first cam roller serving for a permanent contact of a first low lift or zero lift cam of a cam assembly, a second one of the cam rollers being axially fixed on said axle and being displaceable by this axle into two positions, a first one of said positions serving to switch to the high valve lift during which the second cam roller can be displaced through the axle into a central position in the recess, so that a contact of the high lift cam of the cam assembly is enabled, a second one of said positions serving to switch off the high valve lift [switching to low or zero valve lift] during which the second cam roller can be displaced through the axle into a position in front of the second side wall, so that a contact of a further low lift or zero lift cam of the cam assembly is enabled, and the cam rollers are approximately equally spaced from a central longitudinal axis of the lever opposite each other in said second position.

In this way, a switchable lever is provided in which the initially mentioned drawbacks are eliminated. When switching is to be effected, the axle together with the second cam roller is displaced during the cam base circle phase by a servo means such as an electromagnetic actuator or by a hydraulic medium or by force of a compression spring between two positions while the first cam roller remains fixed against displacement.

As stops for defining the two positions of the axle, it is proposed, for example, to arrange simple locking rings on the axle, which locking rings come to abut against an outer side of the respective side wall thus realizing a stop.

The scope of protection of the invention also relates to a system made up of the lever and the contacting cam assembly.

If necessary, it is also possible to use a sliding surface in place of the first cam roller. Further, it is also imaginable and intended to enable switching to three different cam lifts (zero, low and high lift).

The lever, which according to a further development of the invention can be made out of sheet steel, a precision casting or an MIM material or the like is relatively light in weight and requires a comparatively small design space. Moreover, due to the omission of the coupling slide, an adjustment of coupling lash is no longer required and complex channels for a hydraulic medium within the lever for supplying this to the coupling slide can also be omitted. Due to the roller contact in both switching modes, only a small amount of friction work is to be expected.

According to a further proposition, both cam rollers can be arranged on the axle through a sliding or a rolling bearing mounting. Alternatively, only one of the cam rollers may have a sliding mounting and the other cam roller, a rolling bearing mounting. For example, only the second cam roller fixed on the axle may have a slide mounting.

To enable an unobstructed displacement of the axle relative to the first cam roller, it is proposed to arrange the first cam roller on a hollow axle that is seated in the bore of the first side wall and through which the axle extends rotatable and displaceable relative thereto.

It seems to be perfectly obvious to fix the hollow axle on the first side wall through a radial collar that protrudes from the hollow axle and can extend on an outer side of the first wall. A further radial collar retains the first cam roller within the recess axially fixed relative to an inner side of the first side wall. The hollow axle is made preferably out of thin-walled sheet steel.

To achieve different states of switching, it is both imaginable and intended to displace both the rollers towards each other or together with each other as an assembly.

For mounting the lever at the one end, the invention proposes a support on a head of a hydraulic or mechanical support element (finger lever). It is further possible to mount the lever at the one end on an axis of oscillation (oscillating lever). Alternatively, the lever can also be a rocker arm whose roller assembly is then seated at one end.

The cross-section of the lever can have a U-shape, an inversed U-shape or an H-like or T-like shape. According to a further feature of the invention, the lever may be bellied in a top view only in its central region near the cam rollers and be "retreated" at its ends relative to the central region so that design space is saved. If necessary, in place of the central recess for the rollers, the crossbar can be vaulted all through and, in the central section, appropriately in a direction of the underside.

BRIEF DESCRIPTION OF THE DRAWINGS

Coming now to the drawing:

FIG. 3 shows a top view of the lever, and in

DETAILED DESCRIPTION OF THE PREFERRED EMBODIMENTS

Figure 2:
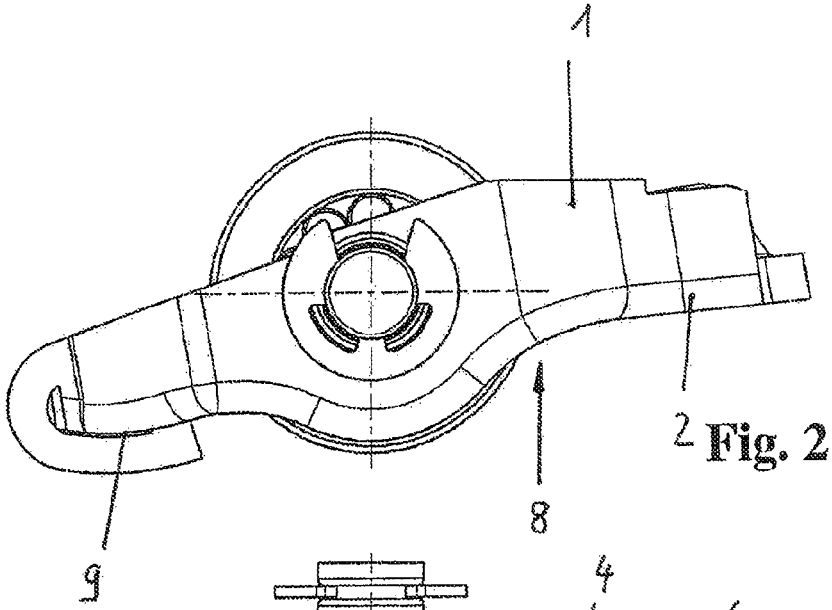
FIG. 2 shows the lever in a side view.
Figure 3:
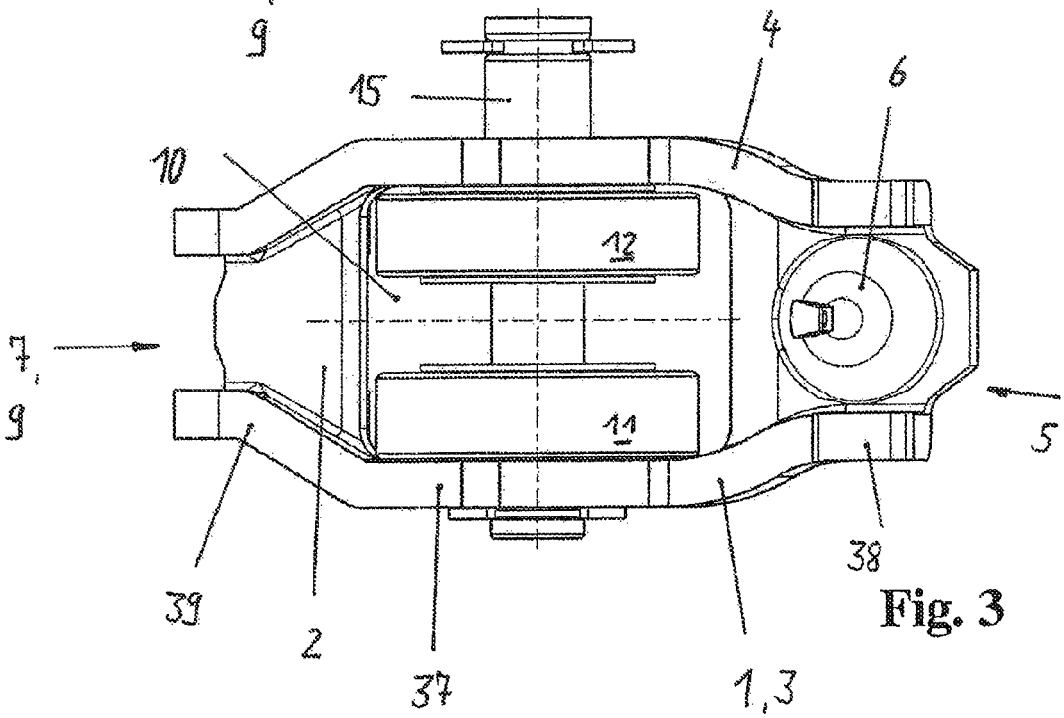

What is shown is a lever 1 for a valve train of an internal combustion engine. As best seen in FIGS. 2, 3, the lever 1 comprises two side walls 3, 4 connected on an underside 8 by a crossbar 2. At one end 5, the lever 1 comprises a bearing 6 configured as a semi-circular depression in the crossbar 2 for a pivotal support of the lever 1 relative to a head of a support element. At the other end 7, the crossbar 2 comprises a support 9 for a gas exchange valve.

The lever 1 has a relatively compact design. In a top view, the lever 1 comprises a central bellied section 37 comprising the recess 10 and, at the ends 5, 7, two sections 38, 39 that are retreated relative to the bellied section 37.

Between the ends 5, 7, the crossbar 2 comprises a recess 10. Two cam rollers 11, 12 extend within the recess 10 while being seated on an axially displaceable axle 15 that is mounted in bores 13, 14 of the side walls 3, 4. From FIGS. 4, 5, it can be seen that the first cam roller 11 is mounted on the axle 15 through a needle roller bearing 25 and the second cam roller 12 through a slide bearing 26. Fixing of the second cam roller 12 on the axle 15 is realized through a locking ring 28 that is seated in an annular groove 27 of the axle 15 and, at the same time, in an annular groove 29 of a bore 30 of the second cam roller 12.

Figure 1:
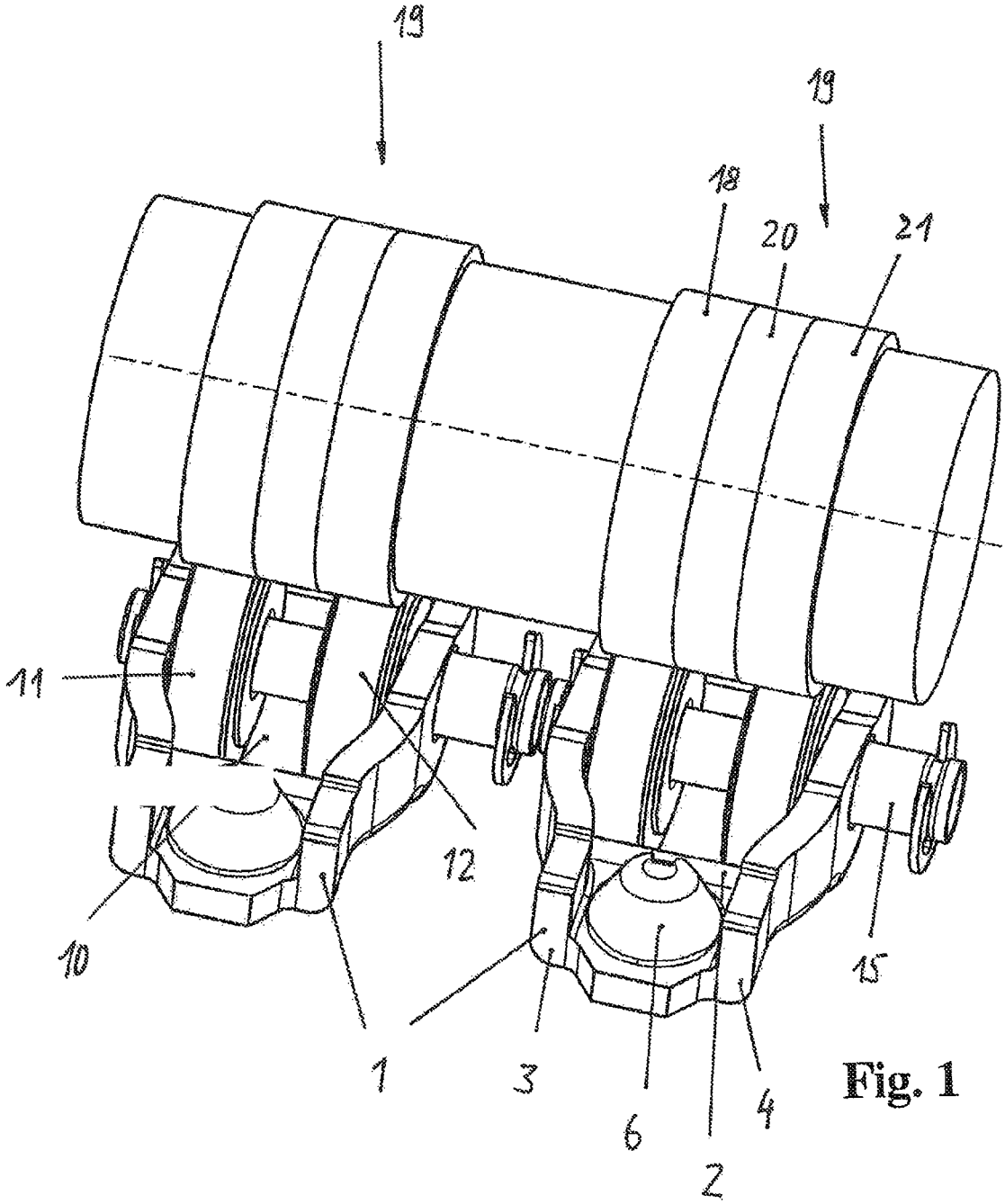
FIG. 1 discloses the lever in contact with a cam assembly.

A hollow axle 16 arranged on the axle 15 extends out of the bore 13 of the first side wall 3 axially in an inward direction. The first cam roller 11 is guided axially fixed on the hollow axle 16 in front of an inner side 17 of the first side wall 3. The first cam roller 11 serves for a permanent contact with a first low lift cam 18 of a cam assembly 19 (see also FIG. 1).

As already mentioned, the second cam roller 12 extends axially fixed on the axle 15 and can be displaced by this axle 15 into two positions. A first position serves for switching to a high valve lift. For this purpose, the second cam roller 12 is displaced into a central position within the recess 10 by the axle 15 (see FIG. 5) which is loaded by a servo means (see arrows at front ends of the axle 15 in FIGS. 4, 5). In this way, a contact with a high lift cam 20 of the cam assembly 19 is enabled.

A second position of the cam roller 12 serves to shut off the high valve lift and to switch to a low valve lift. For this purpose, the second cam roller 12 is displaced through the axle 15 to a position in front of the second side wall 4 (see FIG. 4), so that a contact with a further low lift cam 21 of the cam assembly 19 is enabled (see also FIG. 1). It is perceptible that, in this case, the cam rollers 11, 12 are situated opposite each other approximately equally spaced from the central longitudinal axis of the lever 1, so that their loading can be described as symmetrical, while it can be determined that even in the first position, their loading is only inconsiderably asymmetric.

The hollow axle 16 is a thin-walled sheet metal tube and is seated rotationally fixed in the bore 13. The hollow axle 16 is retained on an outer side 23 of the first side wall 3 through a radial collar 22 situated axially on the outside. Axially on the inner side, the hollow axle 16 comprises a further radial collar 24 between which radial collar 24 and the inner side 17 of the first side wall 3 the first cam roller 11 is guided.

Figure 4:
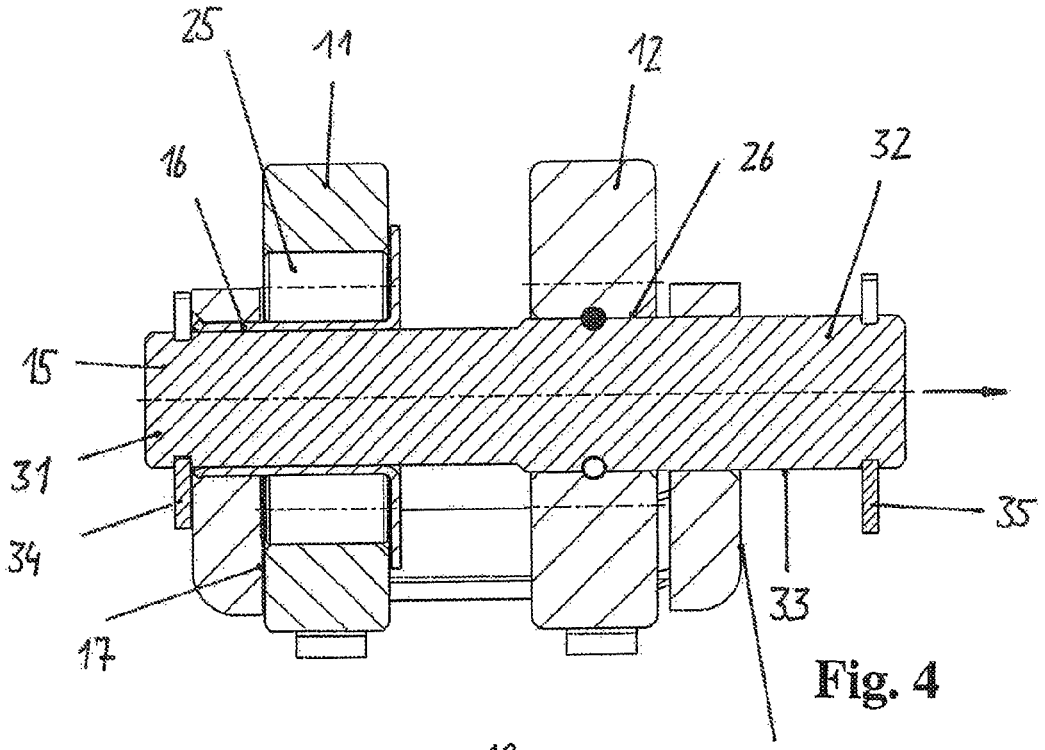
FIGS. 4 and 5, the cam rollers together with the axle are shown in their two switching states.
Figure 5:
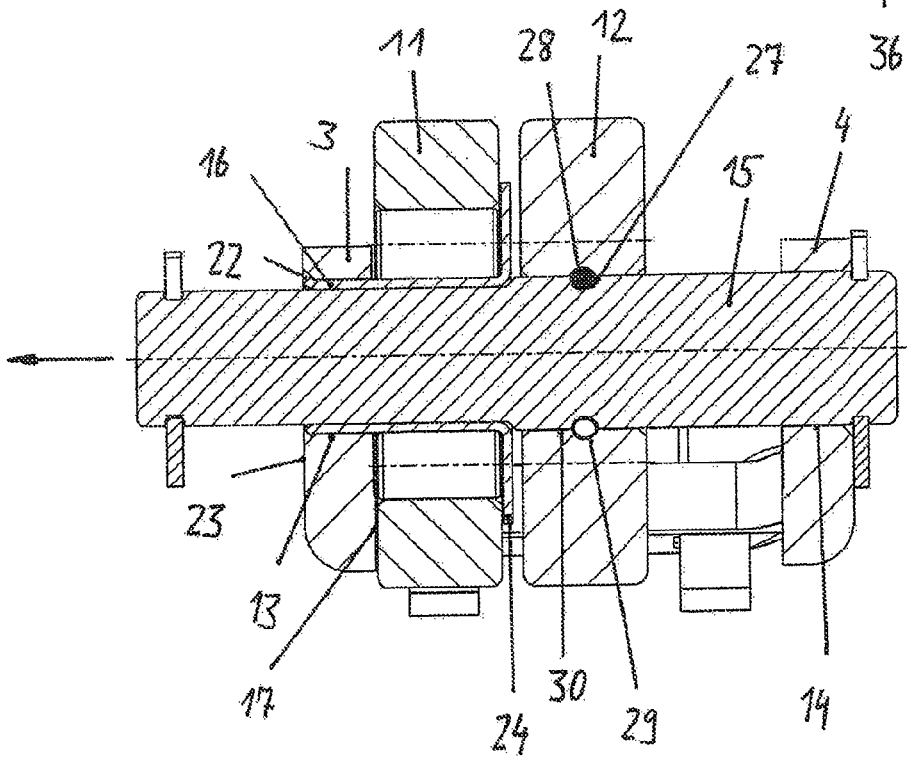

To enable switching to the two positions, the axle 15 protrudes with both its ends 31, 32 laterally beyond the lever 1. As best seen in FIGS. 4, 5, stop projections 34, 35 configured as simple locking rings project from the outer peripheral wall 33 of the axle 15 on both sides. When the first stop projection 34 comes to abut against the outer side 23 of the first side wall 3, the second position (low lift) is defined, while an abutment of the second stop projection 35 against an outer side 36 of the second side wall 4 defines the first position.

LIST OF REFERENCE NUMERALS

1 Lever
2 Crossbar
3 Side wall
4 Side wall
5 One end
6 Bearing
7 Another end
8 Underside
9 Support
10 Recess
11 First cam roller
12 Second cam roller
13 Bore of first side wall
14 Bore of second side wall
15 Axle
16 Hollow axle
17 Inner side
18 First low lift cam
19 Cam assembly
20 High lift cam
21 Second low lift cam
22 Radial collar
23 Outer side
24 Radial collar
25 Needle roller bearing
26 Slide bearing
27 Annular groove
28 Locking ring
29 Annular groove
20 Bore
31 End of axle
32 End of axle
33 Outer peripheral wall
34 Stop projection
35 Stop projection
36 Outer side
37 Bellied section
38 Retreated section
39 Retreated section

What is claimed is:

1. A switchable lever for a valve train of an internal combustion engine, said switchable lever comprising side walls connected by a crossbar and on one end, a bearing for enabling a pivotal support of said lever and, on another end, on an underside of said crossbar, a support for at least one gas exchange valve, said crossbar comprising between said one end and said another end, a recess with two cam rollers extending therein while being seated on an axle which is mounted in bores in said side walls and is displaceable in an axial direction, a hollow axle arranged on said axle extending out of the bore of the first side wall axially inwards, a first one of the cam rollers being guided, axially fixed on said hollow axle in front of an inner side of the first side wall, said first cam roller serving for a permanent contact of a first low lift or zero lift cam of a cam assembly, a second one of the cam rollers being axially fixed on said axle and being displaceable by said axle into two positions, a first one of said positions serving to switch to a high valve lift during which the second cam roller is displaceable by said axle into a central position in the recess, so that a contact of a high lift cam of the cam assembly is enabled, a second one of said positions serving to switch off the high valve lift during which the second cam roller is displaced by the axle into a position in front of the second side wall, so that a contact of a further low lift or zero lift cam of the cam assembly is enabled, and said cam rollers are situated opposite each other approximately equally spaced from a central longitudinal axis of the lever.

2. A lever according to claim 1, wherein the hollow axle in the bore of the first side wall is made as a thin-walled sheet metal tube that is seated rotationally fixed in the bore and is retained on an outer side of the first side wall through a radial collar that is situated axially on the outer side, the hollow axle comprising on an axially inner side, a further radial collar between which further radial collar and the inner side of the first side wall the first cam roller is guided.

3. A lever according to claim 1, wherein either a) both of the cam rollers are arranged through a same type of mounting on the axle or b) one cam roller is arranged through a first type of mounting and the other cam roller is arranged through a second type of mounting on the axle.

4. A lever according to claim 3, wherein, for fixing the slide bearing, the axle comprises in a peripheral region of the second cam roller an annular groove in which a locking ring is seated, said locking ring also extends in a respective annular groove of a bore of the second cam roller, or the second cam roller retained by undulatory locking rings seated on both sides of the second cam roller in an annular groove of the axle.

5. A lever according to claim 1, wherein the lever is either a finger lever or an oscillating arm, and in case of being configured as the finger lever, the lever comprises on the one end, on an underside, a semi-circular depression as a bearing for a head of a support element.

6. A lever according to claim 1, wherein the lever has a U-shaped or inverse U-shaped cross-sectional profile and is made out of thin-walled sheet steel or as a precision casting or the lever is made by an MIM method.

7. A lever according to claim 1, wherein the axle protrudes with both ends laterally beyond the lever and for realizing the two positions, a stop projection protrudes from an outer peripheral wall of the axle on both sides, and when a first one of the stop projections comes to abut against an outer side of the first side wall, the second position is defined, while an abutment of a second one of the stop projections against an outer side of the second wall defines the first position.

8. A lever according to claim 1, wherein the lever, as seen in a top view, comprises a central bellied section comprising the recess, and two sections that are spaced inwardly relative to the bellied section and situated on the ends.

* * * * *